United States Patent [19]

Sutor et al.

[11] Patent Number: 4,759,533

[45] Date of Patent: Jul. 26, 1988

[54] HEAT-INSULATING BOARDS

[75] Inventors: Peter T. Sutor, Pittsburgh; Leigh F. Brooks, Clairton, both of Pa.

[73] Assignee: Dresser Industries, Inc., Dallas, Tex.

[21] Appl. No.: 6,505

[22] Filed: Jan. 21, 1987

Related U.S. Application Data

[63] Continuation-in-part of Ser. No. 895,401, Aug. 11, 1986, abandoned.

[51] Int. Cl.[4] ..... C21C 5/44

[52] U.S. Cl. ..... 266/280; 266/286; 501/95

[58] Field of Search ..... 266/280, 275, 286; 501/95, 109

[56] References Cited

U.S. PATENT DOCUMENTS 4,339,115 7/1982 Daussan et al. ..... 266/280

4,440,865 4/1984 Salazar ..... 501/95

FOREIGN PATENT DOCUMENTS 0017473 1/1982 Japan ..... 501/95

0027978 2/1982 Japan ..... 501/95

8400747 3/1984 PCT Int'l Appl. ..... 501/95

1226971 3/1971 United Kingdom ..... 266/280

*Primary Examiner*—Peter D. Rosenberg

*Assistant Examiner*—S. Kastler

*Attorney, Agent, or Firm*—Sigalos, Levine & Montgomery

[57] ABSTRACT

A heat-insulating board comprising a molded refractory material having substantially uniformly distributed therethrough flexible thermoset polymer fibers resistant to decomposition at a temperature up to about 400° F. in an amount sufficient to increase the fracture energy of said board, and compositions for making such board.

7 Claims, No Drawings

HEAT-INSULATING BOARDS

CROSS-REFERENCE TO RELATED APPLICATION

The present application in a continuation-in-part of U.S. application Ser. No. 895,401 filed Aug. 11, 1986, entitled "REINFORCED TUNDISH BOARD", now abandoned.

BACKGROUND OF THE INVENTION

The present invention relates to heat-insulating boards used as heat-insulating liners in tundish vessels and other molten metal handling vessels and other situations where heat-insulation is desired. Ordinarily, these boards are refractories of various sizes and shapes with tundish boards, for example, being 1 to 2 feet wide, 3 to 6 feet long and about 1 to 1.5 inches thick.

The tundish, for example, serves as a molten metal reservoir and in order to prevent contamination thereof the used tundish boards are replaced with new tundish boards on a periodic basis. The same is true, for example, with boards used to line ladles and other metallurgical vessels.

However, present heat-insulating boards are too brittle and tend to fracture or break in shipment or handling during use.

At the present time a variety of materials are added to standard refractory materials used to form heat-insulating boards in order to improve the handling strength thereof and in particular toughness and impact resistance. Efforts to improve such properties include imbedding wires such as chicken wire in the board during the forming process. Other materials, such as steel fibers, have been utilized, as well as paper and rock wool (mineral wool or glass wool) fibers. None of these additives however has been successful in giving the improved strength and toughness desired in order to have the board resistant to elastic deformation and crack initiation.

SUMMARY OF THE INVENTION

It has now been found possible to prepare heat-insulating boards having improved toughness in an economic manner.

Briefly, the present invention comprises a heat-insulating board comprising a molded refractory material having substantially uniformly distributed therethrough a thermoset flexible polymer fiber resistant to decomposition at a temperature up to about 400° F. in an amount sufficient to increase toughness; preferably a polyester fiber about ¼ and ½ inch in length. The invention also comprises compositions for making such board as set forth below.

DETAILED DESCRIPTION

With respect to the boards and compositions of the present invention, the two major components are the refractory material and the thermoset flexible polymer fibers. As to the refractory material, it can be any conventionally used in the formation of a heat-insulating board, such as, for example, olivine, fire clay or high alumina refractories, a silicon carbide-graphite mixture, magnesia, refractory silicates, anthracite and the like. The amounts thereof utilized are those conventionally utilized for the purpose of forming a heat-insulating board and vary depending upon the particular needs of the metallurgical vessel to be lined with the board.

Magnesia (dead burned) is preferred in making a high-quality board. The magnesia is ground so that about 50–60% passes through a 325 mesh sieve. While coarser or finer particle size material can be used, it has been noted that particles >28 mesh are difficult to keep in suspension in the slurry and the fine particles make it difficult to dewater the slurry when forming the board.

The critical aspect of the instant invention is the thermoset flexible polymer fiber distributed substantially uniformly throughout the board. It is preferred to utilize for this purpose polyester fibers and in particular those composed of at least 85% by weight of an ester of a dihydric alcohol and terephthalic acid. These are conventional and commercially available fibers. These are ordinarily capable of resisting decomposition at temperatures well above 400° F., a desirable quality of board since a temperature of about 350° to 390° F. is utilized in the final cure in forming the board. In addition to such polyester fibers it is also possible to use any other thermosetting resin fiber made from alkyd resins, allylic resins, amino resins, epoxy resins, phenolic resins, and urethane resins which can be formed into fibers having the decomposition higher than a temperature of about 400° F. In some instances even higher temperature resistance can be obtained by copolymerizing the thermoset resin with other known materials to give it a desired degree of resistance to decomposition. It is also necessary that the fibers be flexible.

In addition, other materials are conventionally added in forming boards. These are materials such as binding resins, filter aids, the pH adjusters which are added in their usual amounts and for their usual effect.

The resins used to bind are any conventionally used in making these boards such as powdered phenolic resins, liquid urea-formaldehyde resins, and the like. The preferred resin is a two-stage powdered (−200 mesh) phenolic novolac resin containing hexamine. The binder resin softens and spreads in the drying oven at temperatures above about 300° F. and then hardens as it cools to bind the refractory particles together to maintain the board in the shape into which it has been molded.

Filter aids conventionally used are paper (usually recycled newspaper) that is agitated with water to form a pulp, cellulose, rock wool fibers, asbestos, and ceramic fibers. These act not only as filter aids when the board slurry is being dewatered abut also provide some strength to the wet cake before it is dried. This assists in handling of the wet cake during manufacture.

Additives such as boric acid are required in some cases to maintain the pH at a level such that the resin used will properly cure (harden).

For optimum performance, it is preferred that the fibers be about one-quarter inch long. A fiber length beyond one-half inch is not preferred since there are problems with clumping and no improvement in strength. As to proportions, an amount of fiber of from about 0.1 to 0.4 parts by weight for each 100 parts by weight of the other solids forming the board gives satisfactory results. An amount of 0.1% shows a minimal reinforcing effect and while an amount above about 0.4% can be added, it has been found that it does not greatly increase the hardness obtained and is costly in terms of the additional fiber needed. The dernier per fiber is not critical, with a dernier per fiber of about 1.5 being suitable. The fibers will bridge any cracks that might propagate through the board based on the initial elastic deformation when exposed to breakage forces during shipping and installation. The fibers also minimize crack formation throughout the tundish board and these long flexible fibers gives much greater toughness and impact resistance.

Another advantage of the boards of the present invention is that they can be formed utilizing conventional molding procedures which are not possible with other additives such as wires which people have tried to include in tundish boards. A conventional method of forming boards which can be applied to the instant invention is to form a slurry of the starting board constituents and inject the same into a forming mold in which it is shaped by dewatering under vacuum. The resultant shaped board in the form of a moist cake is then dried and heated to cause the refractory material to harden into the shape desired. With the instant invention, the polyester fibers are simply added as part of the starting slurry, the mixture agitated to ensure that the fibers are substantially uniformly distributed therethrough, and the refractory material then simply formed in the conventional manner described above.

It will be understood that the boards used as liners for the vessel are formed into the various sizes and shapes required to line the particular vessel; such as a tundish or ladle, to be lined as is presently conventionally done.

The invention will be further described in connection with the following examples which are set forth for purposes of illustration only and in which proportions are in parts by weight unless states otherwise.

In these examples "fracture energy" is the energy required to completely break a 6-inch bar into two pieces and was measured using an Instron mechanical testing machine with a 3-point bend set-up and a high strain rate. The fracture energy was proportional to the area under the load deflection curve and is a measure of toughness.

EXAMPLE 1

A series of tundish board test bars (6 inches) were prepared using the three formulations set forth in Table I below. The samples were prepared by first mixing the powdered magnesia, powdered resin, rock wool, paper slurry, acid, polyester fibers (where used), and water to give a pumpable slurry with a solids content of about 65%. This slurry was then drawn by vacuum into a closed mold lined on all six sides with a fine wire screen. The vacuum drew out the water through the holes in the screen to form a slab of damp solids. The mold was opened, the slabs placed on a drying rack, and dried at temperatures of 350° F. and 390° F. and thereafter cut into six inch bars. At such temperatures the residual water was driven off, and the resin set (was cured) and bonded the particles.

The tundish boards were then tested on an Instron machine as described above and the results are set forth in Table I.

TABLE I

| | A | B | C |
|---|---|---|---|
| Magnesia (dead burned) | 93.4 | 93.4 | 93.4 |
| Phenolic novolac resin (Powdered) | 4.0 | 4.0 | 4.0 |
| Rock wool (thermofilm) | 1.0 | 1.0 | 1.0 |
| Paper | 0.4 | 0.4 | 0.4 |
| Boric Acid | 1.2 | 1.2 | 1.2 |
| ¼" polyester fibers (plus addition) | 0.0 | 0.4 | 0.1 |

TABLE I-continued

| | A | B | C |
|---|---|---|---|
| Bulk Density, pcf | 115 | 108 | 108 |
| Modulus of Rupture, psi | | | |
| 350° F. Cure | 1040 | 960 | 910 |
| 390° F. Cure | 970 | 760 | 850 |
| Fracture Energy, in-lbs/in$^2$ | | | |
| 350° F. Cure | 0.64 | 3.10 | 1.08 |
| 390° F. Cure | 0.56 | 1.66 | 0.76 |

Addition of 0.4% polyester fiber resulted in fracture energy values five times higher than no fiber addition at a cure of 350° F. and three times higher at a 390° F. Cure. This example also shows that the reinforcing effect was minimal when only 0.1 polyester fiber was used.

EXAMPLE 2

The materials, processing steps, and testing procedures of Example 1 were used, except that the percentages of materials in the tundish board test bar formulations set forth in Table II below were utilized. Table II also shows the test results obtained.

TABLE II

| | D | E |
|---|---|---|
| Magnesia | 93.9 | 95.4 |
| Resin | 4.0 | 2.5 |
| Rock wool | 0.5 | 0.5 |
| Paper | 0.4 | 0.4 |
| Boric Acid | 1.2 | 1.2 |
| ¼" polyester fibers (Plus addition) | 0.4 | 0.4 |
| Bulk Density, pcf | 106 | 108 |
| Modulus of Rupture, psi 350° F. Cure | 830 | 570 |
| Fracture Energy, in-lbs/in$^2$ 350° Cure | 2.66 | 3.06 |

These tests show that fracture energy; or toughness, is not reduced if the amount of resin normally used is reduced although the Modulus of Rupture is reduced. This is significant since the resin is at present the most expensive component of the tundish board and the ability to use lower amounts thereof represents a significant cost savings.

EXAMPLE 3

Again, the materials, processing steps, and testing procedures of Example 1 were used, except that the percentages of materials used were those set forth in Example 1. Also, for formulation G, a longer length polyester fiber was used. The formulations and results are set forth in Table III below.

TABLE III

| | F | G |
|---|---|---|
| Magnesia | 93.9 | 93.9 |
| Resin | 4.0 | 4.0 |
| Rock wool | 0.5 | 0.5 |
| Paper | 0.4 | 0.4 |
| Boric Acid | 1.2 | 1.2 |
| ¼" polyester fibers (Plus addition) | | |
| ¼" | 0.4 | — |
| ½" | — | 0.4 |
| Bulk Density, pcf | 106 | 108 |
| Modulus of Rupture, psi 350° F. Cure | 830 | 970 |
| Fracture Energy, in-lbs/in$^2$ | 2.66 | 1.90 |

TABLE III-continued

| | F | G |
|---|---|---|
| 350° Cure | | |

These results show no improvement with longer fibers and subsequent production trials with such longer fibers have shown problems with clumping and poor feed into molds.

While the specific examples have been directed to heat-insulating boards for tundishes, it will be understood that the shaped boards and compositions of the present invention can be utilized as liners with any other molten metal handling vessels, such as bottom and lip pour and teapot ladles; aluminum troughs and transfer ladles; overflow troughs; pour-in boxes for continuous casting, and also as hot top boards for ingot casting and protective boards in foundries and other metal-working location to protect equipment and workers from spashing molten metal.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

We claim:

1. A shaped heat-insulating board comprising a molded refractory material having substantially uniformly distributed therethrough flexible, thermoset polymer fibers resistant to decomposition at a temperature up to about 400° F. in an amount of from about 0.1 to 0.4 parts by weight for each 100 parts by weight of other solids in said board.

2. The board of claim 1, wherein said fibers are polyester fibers from about $\frac{1}{4}$ to $\frac{1}{2}$ inch in length.

3. The board of claim 1 or 2, wherein the refractory material is magnesia.

4. A composition for forming a shaped heat-insulating board for use in molten metal handling vessels comprising a refractory material, a binding resin, and flexible, thermoset polymer fibers resistant to decomposition at a temperature up to about 400° F. in an amount from about 0.1 to 0.4 parts by weight for each 100 parts by weight of other solids in said composition.

5. The composition of claim 4, wherein the refractory material is magnesia, the binding resin is a curable phenolic novolac resin, and the fiber is a polyester fiber.

6. The composition of claim 5, wherein the polyester fiber is from about $\frac{1}{4}$ to $\frac{1}{2}$ inch in length.

7. A composition for forming a shaped heat-insulating board consisting essentially of, for each 100 parts by weight thereof, from about 93 to 96 parts magnesia, about 2.5 to 4 parts curable phenolic novolac resin, about 1 to 1.5 parts filter aid, and about 1 part boric acid, and in addition for each said 100 parts by weight of the foregoing from about 0.1 to 0.4 parts by weight of polyester fiber.

* * * * *